US007931066B2

(12) United States Patent
Honda et al.

(10) Patent No.: US 7,931,066 B2
(45) Date of Patent: Apr. 26, 2011

(54) ROMAN SHADE

(75) Inventors: Toshimitsu Honda, Tokyo (JP); Tomonori Muto, Tokyo (JP); Hiroyuki Someya, Tokyo (JP); Toshiyuki Mori, Tokyo (JP)

(73) Assignee: Toso Company, Limited, Tokyo (JP)

( * ) Notice: Subject to any disclaimer, the term of this patent is extended or adjusted under 35 U.S.C. 154(b) by 169 days.

(21) Appl. No.: 12/282,018

(22) PCT Filed: Feb. 21, 2007

(86) PCT No.: PCT/JP2007/053148

§ 371 (c)(1),
(2), (4) Date: Sep. 8, 2008

(87) PCT Pub. No.: WO2007/102314

PCT Pub. Date: Sep. 13, 2007

(65) Prior Publication Data

US 2009/0020235 A1 Jan. 22, 2009

(30) Foreign Application Priority Data

Mar. 9, 2006 (JP) ..... 2006-064016
Oct. 20, 2006 (JP) ..... 2006-285973

(51) Int. Cl.

| | |
|---|---|
| ***A47H 5/00*** | (2006.01) |
| ***A47H 1/00*** | (2006.01) |
| ***E06B 3/48*** | (2006.01) |
| ***E06B 9/30*** | (2006.01) |

(52) U.S. Cl. ..... 160/84.01; 160/84.03; 160/87; 160/115; 160/126; 160/170

(58) Field of Classification Search ..... 160/87, 160/123, 113, 114, 115, 119, 84.01, 84.03, 160/126, 170, 171
See application file for complete search history.

(56) References Cited

U.S. PATENT DOCUMENTS 4,953,610 A * 9/1990 Phillips et al. ..... 160/84.03
5,054,534 A * 10/1991 Hong ..... 160/84.02
5,090,466 A * 2/1992 Hong ..... 160/84.04

(Continued)

FOREIGN PATENT DOCUMENTS

JP 62-199496 U 12/1987

(Continued)

OTHER PUBLICATIONS

English language machine translation of JP 2003-093220.

(Continued)

*Primary Examiner* — Blair M Johnson
*Assistant Examiner* — Jaime F Cardenas-Garcia
(74) *Attorney, Agent, or Firm* — Greenblum & Bernstein, P.L.C.

(57) ABSTRACT

Upper ends of the first fabric and the second fabric are attached to the head rail, respectively, and the first lift cord and the second lift cord suspended from the head rail in a liftable manner are coupled to the first fabric and the second fabric, respectively. The first lift cord is routed into a rear side of the first fabric and the second lift cord is routed into a rear side of the second fabric so as to come over an upper end of the second fabric. An extension member is provided so as to extend downwardly along with a lower edge of a rear portion of the head rail, and the upper end of the second fabric is attached to a front surface of the extension member.

9 Claims, 9 Drawing Sheets

U.S. PATENT DOCUMENTS

| | | | | |
|---|---|---|---|---|
| 5,205,333 | A * | 4/1993 | Judkins | 160/84.02 |
| 5,205,334 | A * | 4/1993 | Judkins | 160/89 |
| 5,205,335 | A * | 4/1993 | Horton et al. | 160/115 |
| RE34,273 | E * | 6/1993 | Phillips et al. | 160/84.01 |
| 5,274,357 | A * | 12/1993 | Riordan | 340/550 |
| 5,440,289 | A * | 8/1995 | Riordan | 340/550 |
| 5,988,254 | A * | 11/1999 | Hanright | 160/84.01 |
| 6,712,115 | B2 * | 3/2004 | Judkins | 160/32 |
| 6,964,291 | B2 * | 11/2005 | Judkins | 160/170 |
| 6,988,526 | B2 * | 1/2006 | Judkins | 160/84.01 |
| 7,063,122 | B2 * | 6/2006 | Colson et al. | 160/84.03 |
| 7,124,802 | B2 * | 10/2006 | Sudano | 160/89 |
| 7,520,311 | B2 * | 4/2009 | Drew | 160/171 |
| 7,654,299 | B2 * | 2/2010 | LeBlanc et al. | 160/84.01 |
| 7,686,059 | B2 * | 3/2010 | Jarosinski et al. | 160/84.03 |
| 2004/0074611 | A1 * | 4/2004 | Colson et al. | 160/84.05 |
| 2004/0154754 | A1 * | 8/2004 | Judkins | 160/84.01 |
| 2005/0155721 | A1 * | 7/2005 | Pon | 160/84.01 |
| 2006/0027336 | A1 * | 2/2006 | Lin | 160/84.01 |
| 2006/0151126 | A1 * | 7/2006 | Lampe | 160/84.01 |
| 2006/0213625 | A1 * | 9/2006 | Nien et al. | 160/84.01 |
| 2006/0225845 | A1 * | 10/2006 | Marusak et al. | 160/126 |
| 2006/0225846 | A1 * | 10/2006 | Marusak et al. | 160/126 |
| 2006/0249260 | A1 * | 11/2006 | Nien | 160/84.03 |
| 2007/0107854 | A1 * | 5/2007 | Jelic | 160/170 |
| 2007/0144686 | A1 * | 6/2007 | Drew | 160/170 |
| 2008/0035277 | A1 * | 2/2008 | Lin | 160/84.03 |
| 2008/0223530 | A1 * | 9/2008 | Grosso | 160/219 |
| 2008/0230189 | A1 * | 9/2008 | Rossato et al. | 160/115 |
| 2009/0266496 | A1 * | 10/2009 | Dann et al. | 160/84.05 |

FOREIGN PATENT DOCUMENTS

| | | | |
|---|---|---|---|
| JP | 2001-211993 | A | 8/2001 |
| JP | 3379934 | B2 | 2/2003 |
| JP | 2003-93220 | A | 4/2003 |
| JP | 2003-259962 | A | 9/2003 |
| JP | 2004-229837 | A | 8/2004 |
| JP | 2005-325680 | A | 11/2005 |

OTHER PUBLICATIONS

English language machine translation of JP 2005-325680.
English language machine translation of JP 3379934B.
English language translation of JP 62-199496U.
English language machine translation and Abstract of JP 2004-229837.
English language machine translation and Abstract of JP 2001-211993.
English language machine translation and Abstract of JP 2003-259962.

* cited by examiner

[Fig.1]
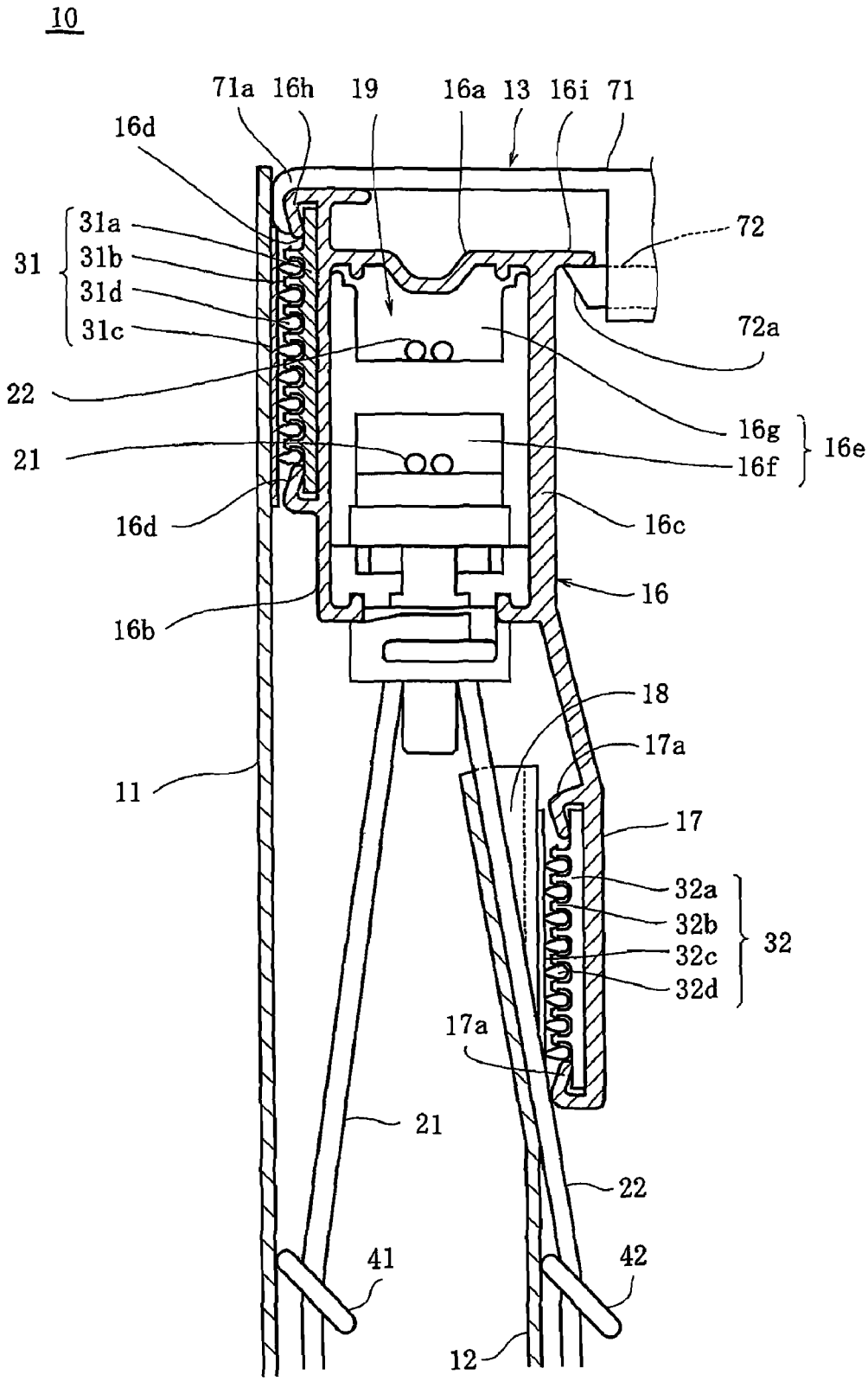

[Fig.2]
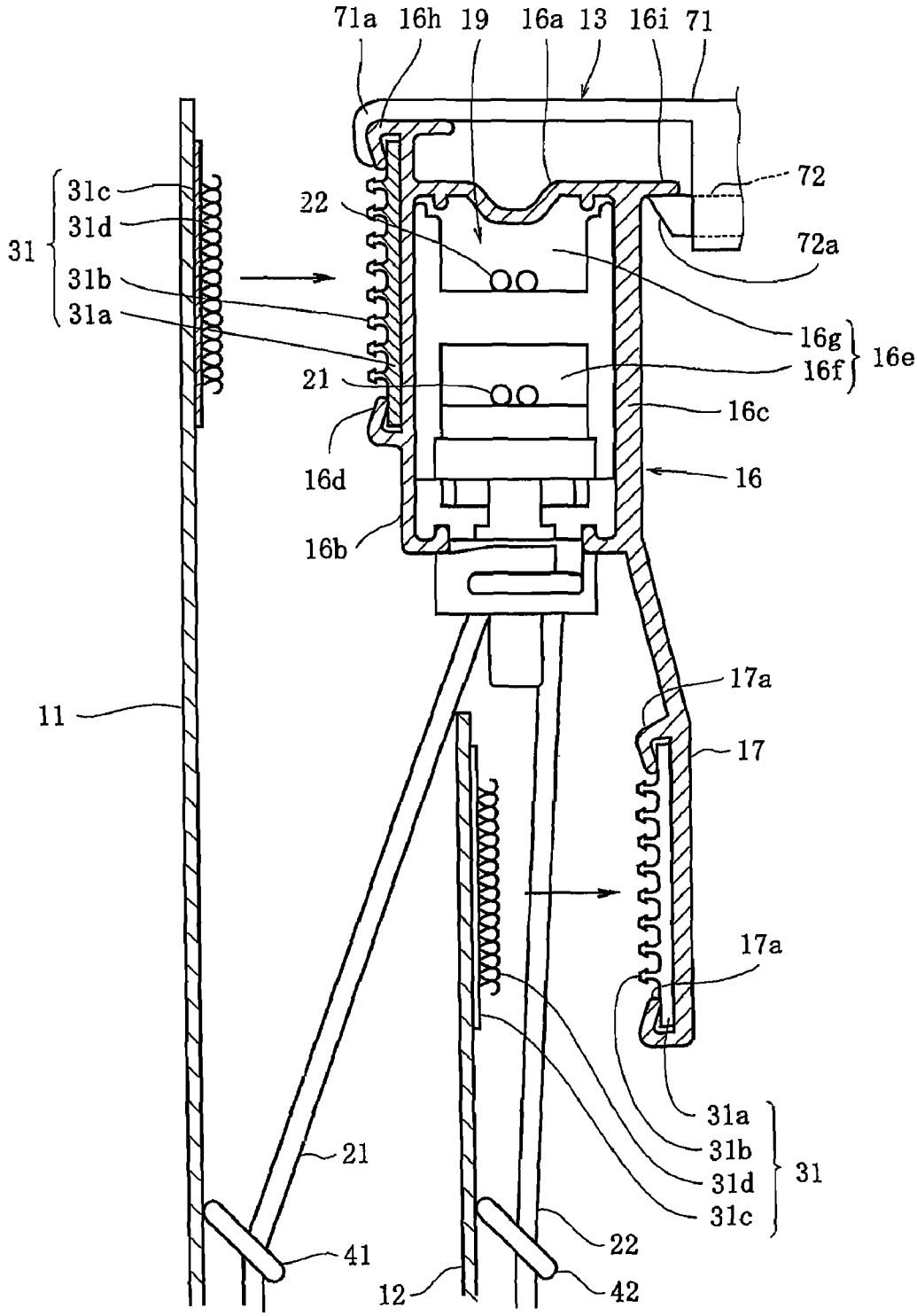

[Fig.3]
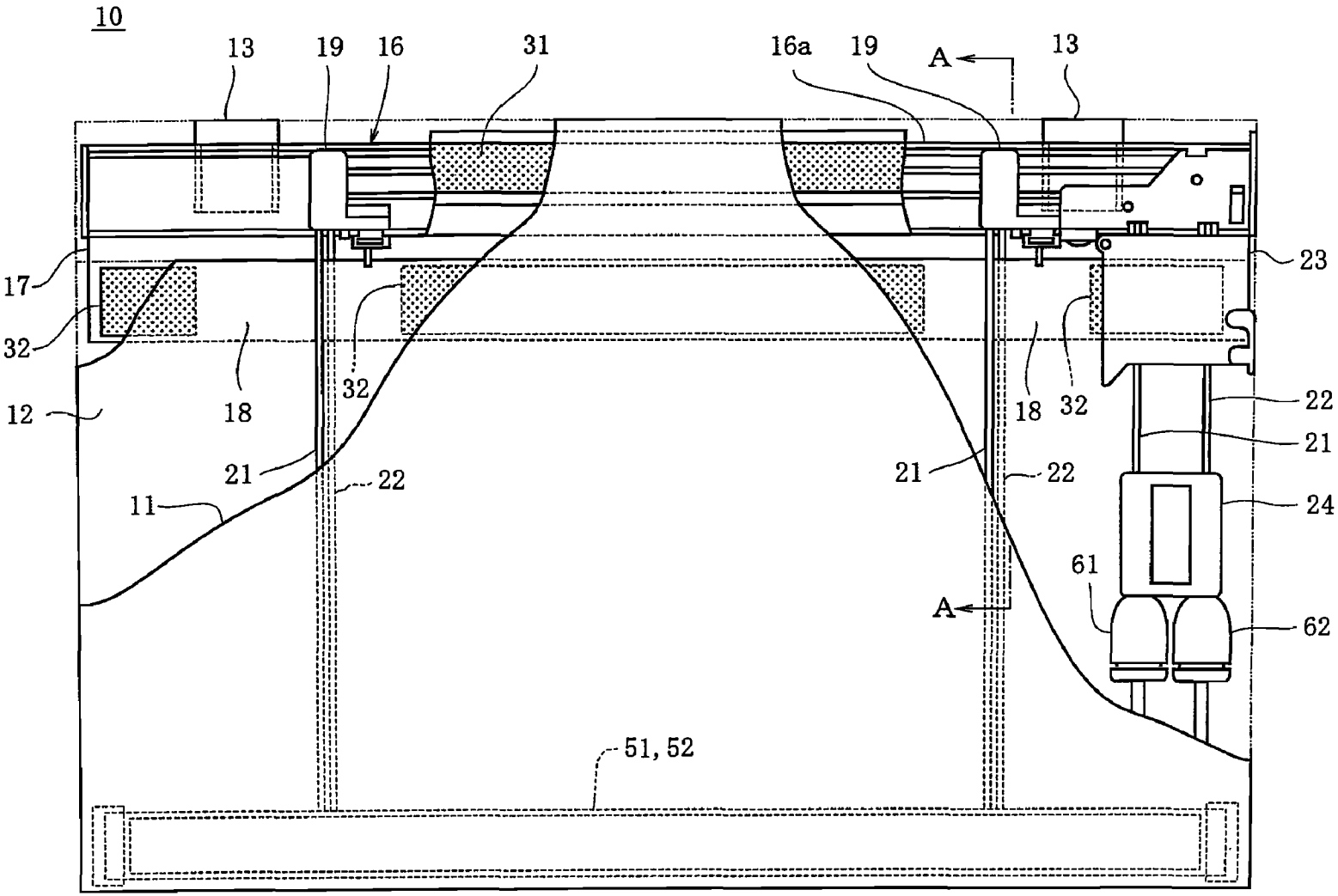

[Fig.4]
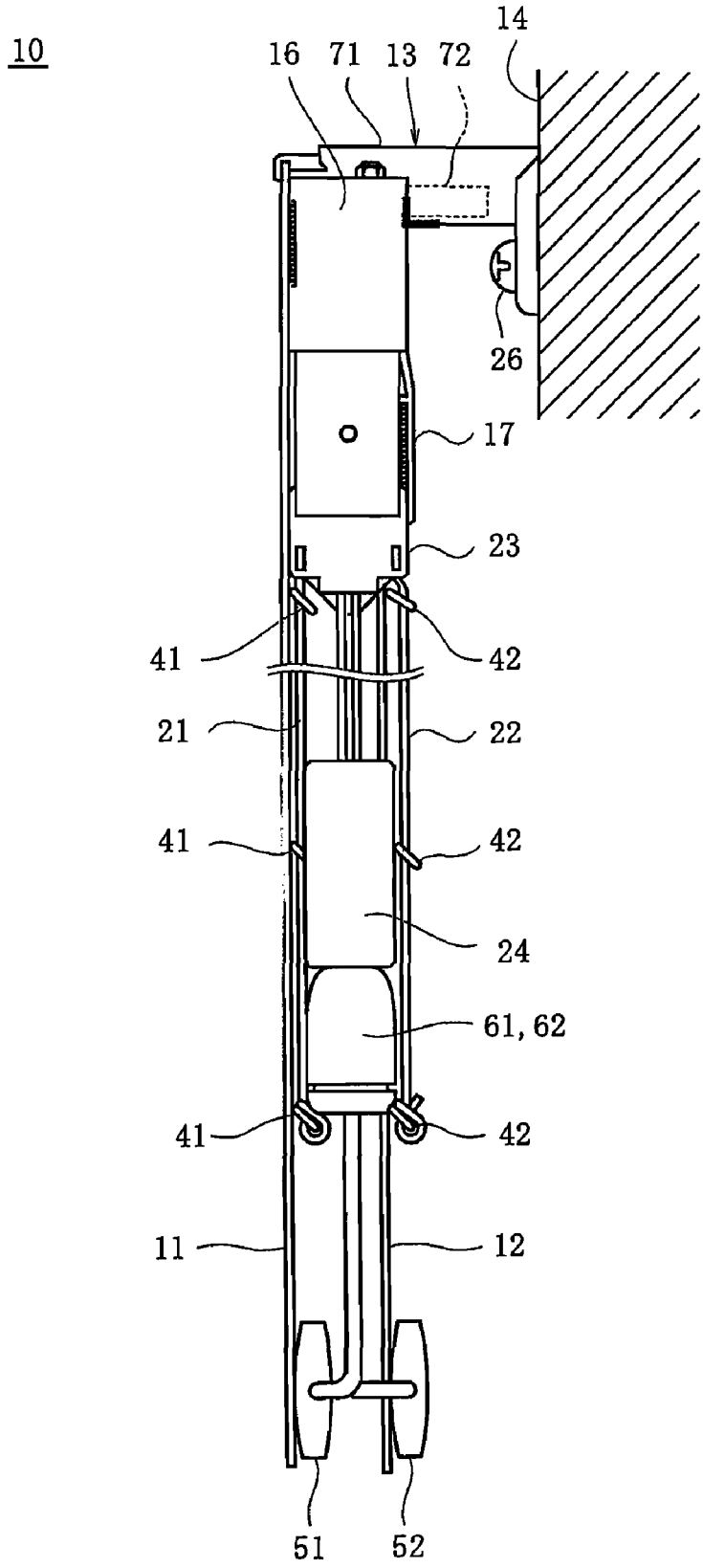

[Fig.5]
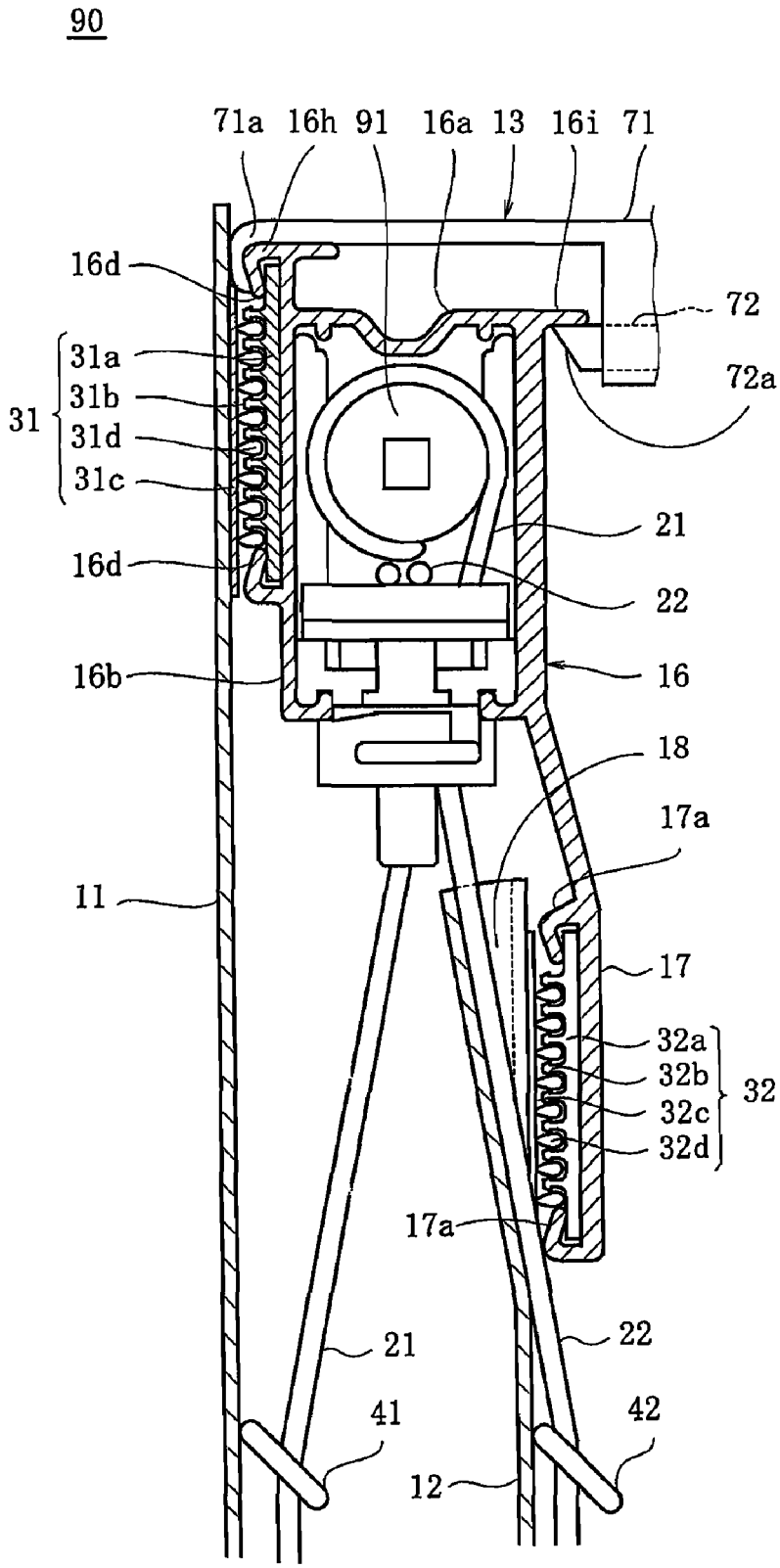

[Fig.6]
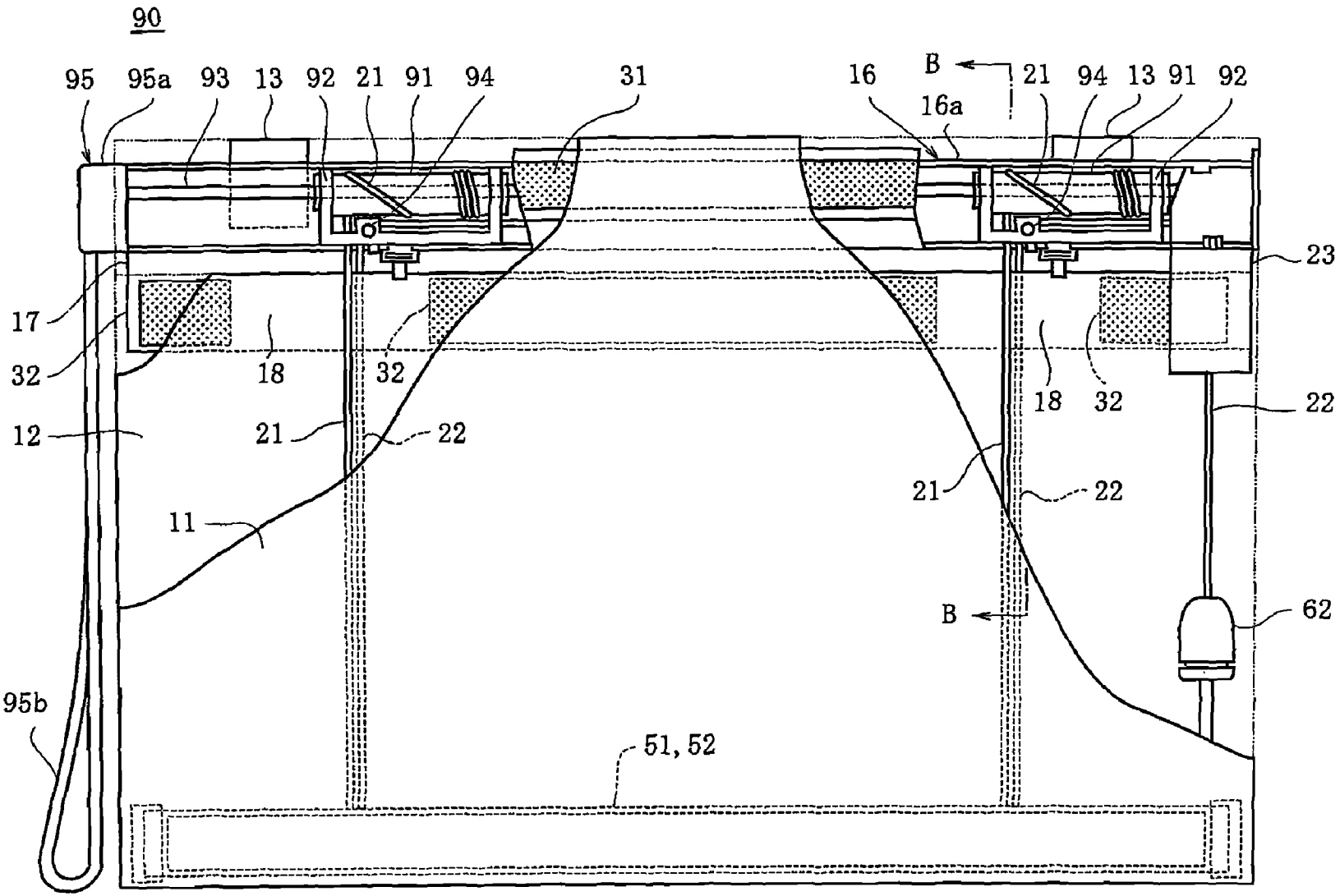

[Fig.7]
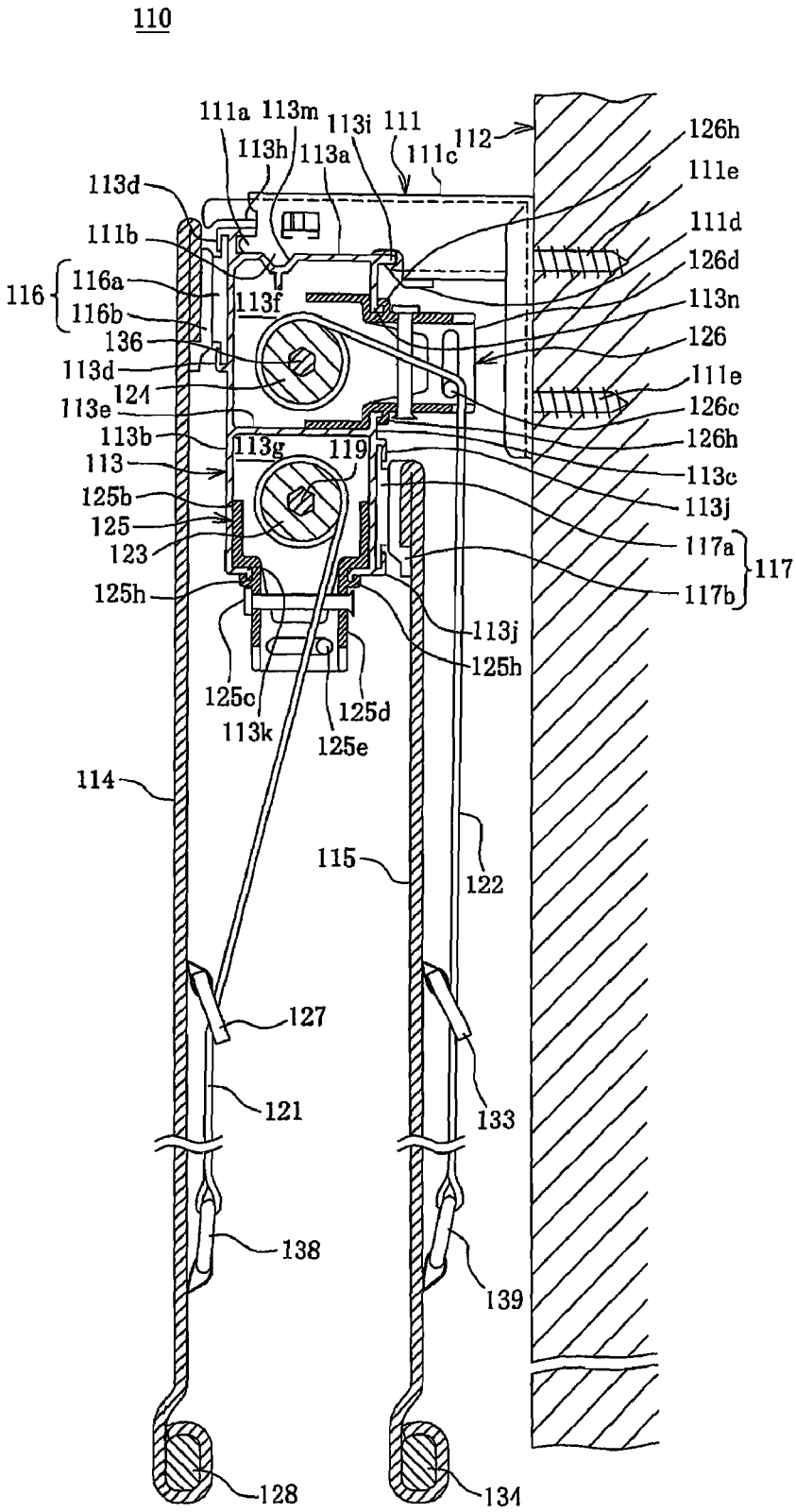

[Fig.8]
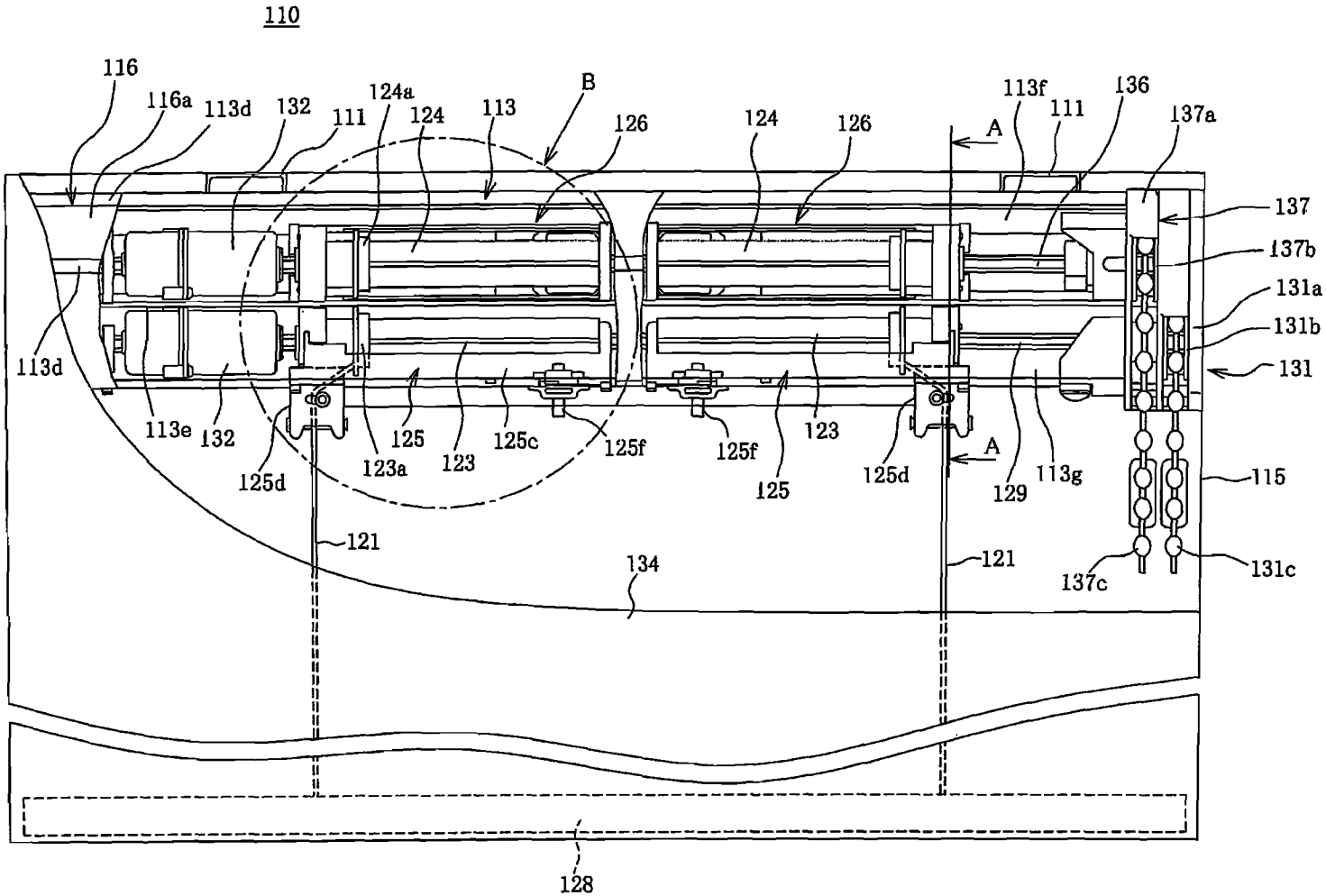

[Fig.9]
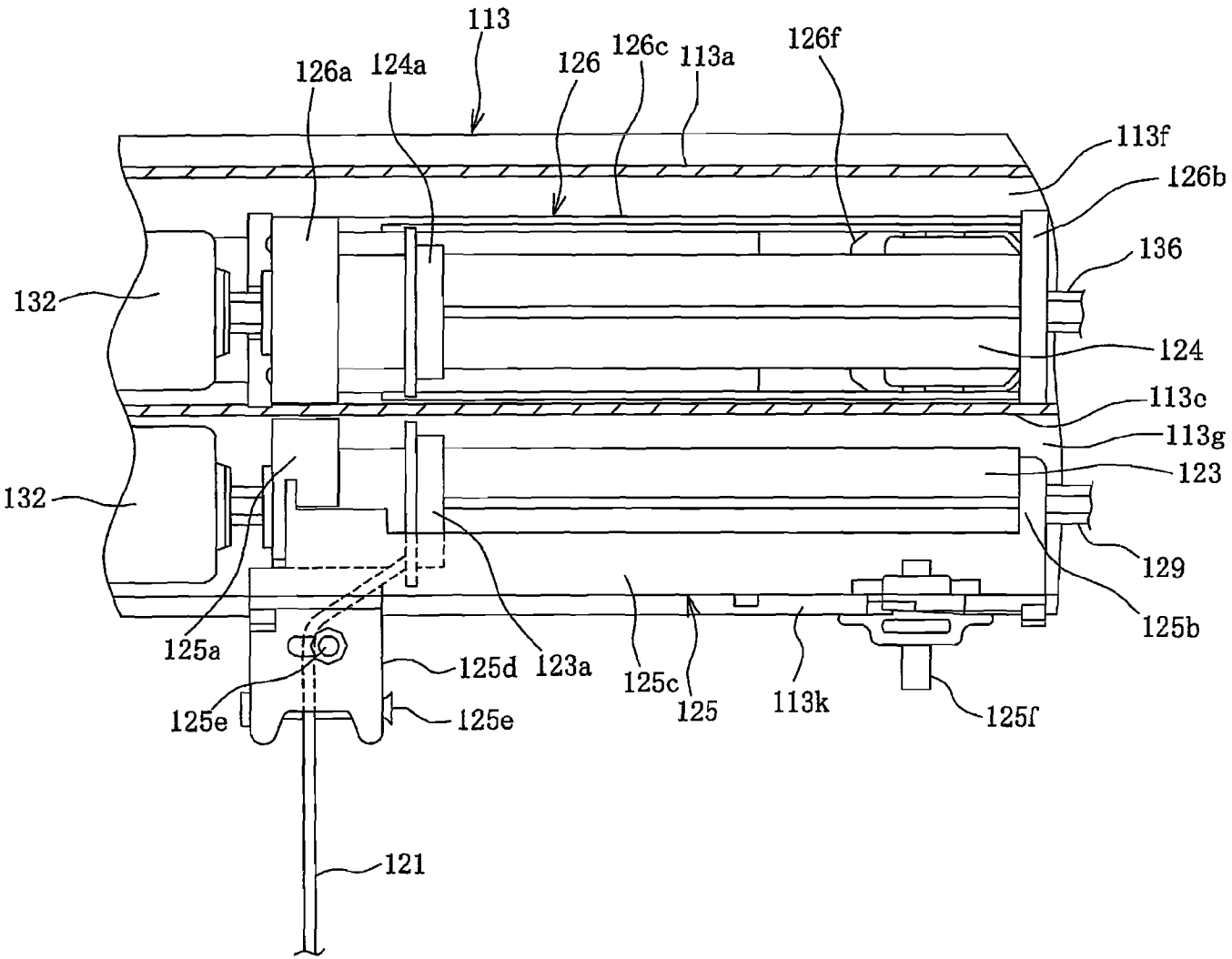

ROMAN SHADE

CROSS REFERENCE TO RELATED APPLICATION

This is a U.S. national phase application under 35 U.S.C. §371 of International Patent Application No. PCT/JP2007/053148 filed Feb. 21, 2007 and claims the benefit of Japanese Application No. 2006-064016 filed Mar. 9, 2006 and Japanese Application No. 2006/285973 filed Oct. 20, 2006, The International Application was published on Sep. 13, 2007 as International Publication No. WO/2007/102314 under PCT Article 21(2) the contents of these applications are incorporated herein in their entirety.

TECHNICAL FIELD

The present invention relates to a roman shade for lifting up/down fabric of which upper ends are attached to a head rail, respectively.

BACKGROUND OF ART

Conventionally, a roman shade which is attached to an opening such as a window or the like of a house from an inside of the room has been known. The roman shade for lifting up/down a fabric of which upper end is attached to a head rail is configured such that the fabric covers the opening and, if required, the fabric is tucked up by rolling up a lift cord in order to let the light in. Recently, a demand for a roman shade including two pieces of fabric is increasing. The roman shade including two pieces of fabric which are attached to a single head rail is proposed, (for example, see Japanese Patent No. 3379934 (("JP '934") claim 1, paragraph [0039] of the text, and FIG. 3). An example of such roman shade includes one in which upper ends of a first fabric and a second fabric are attached to a front surface and a rear surface of the head rail, respectively.

The roman shade is a multi-fabric roman shade in which the two pieces of fabric are attached to a front surface and a rear surface of the head rail, respectively. In the roman shade, a first lift cord and a second lift cord are suspended from the head rail between the first fabric and the second fabric attached to the front surface and the rear surface of the head rail, respectively. Then, an insertion hole is formed near an upper end of the second fabric to allow the second lift cord suspended from the head rail to be inserted into the insertion hole, thereby routing the second lift cord into a rear surface side of the second fabric. In the roman shade having the above described configuration, since the first lift cord and the second lift cord are routed into the rear surface sides of the first fabric and the second fabric, respectively, both lift cords are not exposed when viewed from a front side, and therefore, better appearance can be provided.

However, in the roman shade disclosed in the above conventional JP '934 when only the first fabric is tucked up near to the head rail while the second fabric is down, the insertion hole formed near the upper end of the second fabric is exposed to an inside of the room, thereby causing a problem of degradedness of the appearance of the second fabric.

Also, in the roman shade as disclosed in the above conventional JP '934 since the insertion hole must be formed at a position of the second fabric so as to correspond to a suspended position of the second lift cord, there was a problem in increasing the number of manufacturing steps of the second fabric.

Further, in the roman shade as disclosed in the above conventional JP '934 if a strong light shines onto the second fabric while the first fabric and the second fabric are down, since the light is irradiated onto the first fabric in the form of a spot light through the insertion hole formed in the second fabric, the strong light in the form of the spot light will come into the room through the first fabric if the first fabric is made of a relatively thin fabric. Namely, there is a problem of occurring a filtering of the light in the form of the spot light into the room.

On the other hand, in the roman shade as disclosed in the above conventional JP '934 the head rail is generally mounted horizontally onto a wall surface or a ceiling of the room at a position above an opening such as a window, such that, although it is relatively easy to attach the upper end of the first fabric onto the front surface of the head rail which is facing to the inside of the room, there is such a problem that it requires relatively large number of manufacturing steps to attach the upper end of the second fabric onto the rear surface of the head rail which is facing to the wall surface of the room because of a relatively small space between the rear surface of the head rail and the wall surface of the room.

In order to resolve the above problem, it is conceived that the head rail is mounted onto the wall surface or the like of the room while upper end of the second fabric is preliminary attached to the rear surface of the head rail. However, mounting the head rail, on which the fabric has been preliminary attached, onto the wall surface or the like of the room involves remarkably lower workability in comparison with mounting the head rail without the fabric onto the wall surface or the like of the room. Also, after the head rail is mounted onto the wall surface or the like of the room, the first fabric and the second fabric may be exchanged according to a user's (resident's) taste in order to change design or print of the fabric. As such, there still was a problem of cumbersome in exchanging the second fabric which is attached to the rear surface of the head rail because of a relatively small space between the rear surface of the head rail and the wall surface or the like of the room as having been described above, and thus it takes time to exchange the second fabric.

An object of the present invention is to provide such a roman shade that does not degrade the appearance of the second fabric when the first fabric is tucked up near to the head rail, that does not increase the number of manufacturing steps of the second fabric, and that can prevent the light in the form of the spot light from filtering into the room even if light shines onto the second fabric while the first fabric and the second fabric are down.

Another object of the present invention is to provide a roman shade which can provide an easy attachment of the second fabric onto an extension member extending from the head rail mounted onto the wall surface or the like of the room and an easy exchange of the second fabric.

SUMMARY OF THE INVENTION

An invention is an improvement of the roman shade including, as illustrated in FIG. 1, a head rail; a first fabric and a second fabric of which upper ends are attached to the head rail, respectively; and a first lift cord and a second lift cord suspended from the head rail in a liftable manner, resulting in being coupled to the first fabric and the second fabric, respectively.

The above specific configuration is further characterized in that: the upper end of the first fabric is attached to the front surface of the head rail; the first lift cord suspended from the head rail is routed into the rear side of the first fabric; the extension member projects downwardly along with the lower edge of the rear portion of the head rail; the upper end of the second fabric is attached to the front surface of the extension member; the second lift cord is suspended from the head rail in front of the extension member; an unattached portion which is the upper portion of the second fabric having a predetermined width including the suspended portion of the second lift cord and free from attachment to the front surface of the extension member is provided, when the second fabric is viewed from the front; and the second lift cord having been suspended from the head rail is routed into the rear side of the second fabric from the front side of the second fabric so as to come over the upper end of the second fabric and passing through the unattached portion.

In the roman shade, the first lift cord suspended from the head rail is routed into the rear side of the first fabric, and the second lift cord, which is suspended from the head rail and lifts up/down the second fabric, is routed into the rear side of the second fabric so as to come over the upper end of the second fabric, such that the second lift cord is almost completely isolated from the first lift cord to thereby prevent the second cord from entangling with the first lift cord, and an appearance of the second fabric would not be degraded since the second lift cord hides behind the second fabric even when the first fabric is tucked up near to the head rail.

Also in the above roman shade when the first fabric and the second fabric are attached to the head rail or the like after the head rail has been mounted onto the wall surface or the like of the room, the upper end of the second fabric is initially attached to the front surface of the extension member facing to the wide space open to the inside of the room and thereafter the upper end of the first fabric is attached to the front surface of the head rail facing to the wide space open to the inside of the room. Accordingly, in comparison with the conventional roman shade which involves a cumbersome in an attachment operation because the second fabric is attached to the rear surface of the head rail through a relatively small space between the rear surface of the head rail having been mounted to the wall surface or the like of the room and the wall surface of the room, the present invention can attach the second fabric to the front surface of the extension member of the head rail having been mounted onto the wall surface or the like of the room with greater ease.

An invention described above is an improvement of the invention according to the above and is characterized in that: the extension member is provided integrally with the head rail and is formed into a plate shape having substantially the same length as that of the head rail.

In the roman shade as described above, since the extension member is provided integrally with the head rail the number of parts will not increase. Also, since the extension member is formed into the plate shape having substantially the same length as that of the head the extension member can be formed concurrently with the head rail by means of an extrusion molding or a pultrusion molding.

An invention is an improvement of the roman shade including: the head rail; the first fabric and the second fabric of which upper ends are attached to the head rail; and the first lift cord and the second lift cord which are suspended from the head rail in a liftable manner and coupled to the first fabric and the second fabric, respectively. The above described roman shade is characterized in that; the upper end of the first fabric is attached to the front surface of the head rail; the first lift cord suspended from the head rail is routed into the rear side of the first fabric; the upper end of the second fabric is attached to the rear surface of the head rail; and the second lift cord is pulled out into the rear side of the head rail so as to come over the upper end of the second fabric to be suspended into the rear side of the second fabric.

In the roman shade as recited below, since the second lift cord is pulled out from the upper space into the rear side of the head rail to be directly suspended into the rear side of the second fabric, the insertion hole, having been required in the conventional roman shade, for guiding the second lift cord to the rear side of the second fabric is no more necessary. Therefore, the insertion hole becomes unnecessary, resulting in that the number of processing steps for forming the insertion hole in the second fabric, which has been conventionally necessitated, can be omitted.

An invention according to this embodiment is characterized in that: top of the first lift cord suspended from the head rail is guided in the longitudinal direction within the head rail to be suspended downwardly from the end of the head rail the second lift cord suspended from the head rail.

An invention according to an improvement and is characterized in that: a front side cord roll-up drum which rolls up the first lift cord and a rear side cord roll-up drum for rolling up the second lift cord are provided; and the front side cord roll-up drum and the rear side cord roll-up drum above the front side cord roll-up drum are enclosed within the head rail.

In the roman shades as recited above, since the head rail encloses the first lift cord or the front side cord roll-up drum, and the second lift cord or the rear side cord roll-up drum, a width of the head rail can be equalized to that of the head rail which encloses a single roll-up drum. Therefore, an amount of the first fabric projecting into the room can be prevented from increasing.

Another embodiment is characterized in that: the top of the second lift cord is guided in the longitudinal direction of the head rail within the head rail at a position above the first lift cord; the head rail includes a partition for dividing an inside of the head rail into two sections, i.e., an upper section and a lower section; and the partition serves to form a lower space for enclosing the first lift cord extending in the longitudinal direction within the head rail and an upper space for enclosing the second lift cord extending in the longitudinal direction above the lower space.

A further embodiment is characterized in that: the head rail includes therein the partition for dividing the inside of the head rail into two sections, i.e., the upper section and the lower section; and the partition serves to form the lower space for enclosing the first lift cord extending in the longitudinal direction within the head rail or the drum for rolling up the first lift cord, and the upper space for enclosing the drum for rolling up the second lift cord above the lower space or the second lift cord extending in the longitudinal direction of the head rail.

An invention according to the below is an improvement of the invention above, and is characterized in that: the head rail includes the partition which divides the inside of the head rail into two sections, i.e., the upper section and the lower section; and the partition serves to form within the head rail the lower space for enclosing the front side cord roll-up drum and the upper space for enclosing the rear side cord roll-up drum above the lower space. In the roman shade as recited above, the lower space sectioned by the partition encloses the first lift cord or the front side cord roll-up drum, and the upper space sectioned by the partition encloses the second lift cord or the rear side cord roll-up drum, such that they can be protected from a mutual interference.

An invention according to an improvement of the invention above is characterized in that: a guide member is provided in order to guide the second lift cord, having been pulled out into the rear side of the head rail from the upper space, to the rear side of the second fabric.

In the roman shade as recited above, since the guide member guides the second lift cord, having been pulled out into the rear side of the head rail, to the rear side of the second fabric, a friction resistance between the second lift cord and the second fabric can be prevented from being unnecessary larger. As a result thereof, an operation load upon lifting up/down the second fabric can be decreased.

As described above, according to the present invention, the first lift cord suspended from the head rail is routed into the rear side of the first fabric and the second lift cord suspended from head rail for lifting up/down the second fabric is routed into the rear side of the second fabric so as to come over the upper end of the second fabric, such that the second lift cord is almost completely isolated from the first lift cord so as not to be entangled with the first lift cord. Also, when the first lift cord is rolled up/down, an appearance of the second fabric would not be degraded since the second lift cord resides behind the second fabric. In this case, if the second lift cord is inserted into an unattached portion of the second fabric of which upper portion is not attached to the front side of the extension member and the second lift cord is routed from the front side of the second fabric to the rear side of the second fabric, the first fabric would not be lifted up/down unintentionally when the second lift cord is lifted up/down, such that only the second fabric can be securely lifted up/down. Also, since the upper end of the first fabric and the upper end of the second fabric are attached to the front surface of the head rail and the front surface of the extension member, respectively, if the first fabric and the second fabric are attached to the head rail after the head rail has been mounted to the wall surface or the like of the room, the upper end of the second fabric is initially attached to the front surface of the extension member facing to a wide space open to the inside of the room and then the upper end of the first fabric is attached to the front surface of the head rail facing to the wide space open to the inside of the room, thereby improving not only an attachment operability of the first fabric but also an attachment operability of the second fabric.

Also, in comparison with the conventional roman shade which involves such problems that the insertion hole formed near the upper end of the second fabric may be exposed to the inside of the room to thereby degrading the appearance of the second fabric as well as the increased number of manufacturing steps of the second fabric is necessitated, when only the first fabric is tucked up near to the head rail while the second fabric is down, the roman shade according to the present invention does not include the insertion hole near the upper end of the second fabric such that tucking up only of the first fabric near to the head rail while the second fabric is down would not degrade the appearance of the second fabric or would not increase the number of manufacturing steps of the second fabric. Also, in comparison with the conventional roman shade in which a strong light in the form of a spot light passing through the insertion hole formed in the second fabric transmits the first fabric to cause the light in the form of the spot light to be filtered into the room if the strong light such as a sunlight or the like shines on the second fabric while both of the first fabric and the second fabric are down, the roman shade of the present invention is configured such that a strong light in the form of the spot light would not be irradiated onto the first fabric such that filtering of the light in the form of the spot light into the room can be avoided, even if a strong light such as a sunlight or the like shines on the second fabric while both of the first fabric and the second fabric are down, since the insertion hole is not formed in the second fabric in the roman shade.

Also, in comparison with the conventional roman shade which involves a cumbersome in an attachment operation or an exchange operation of the second fabric to the rear side of the head rail because of a relatively small space between the rear surface of the head rail and the wall surface of the room, when the second fabric is attached to the rear surface of the head rail after the head rail has been mounted onto the wall surface or the like of the room or when the second fabric is exchanged to another one, the roman shade of the present invention is configured such that the attachment operation or the exchange operation of the second fabric to the front surface of the extension member extending from the head rail becomes remarkably easy because the second fabric is attached to the front surface of the extension member facing to the wide space open to the inside of the room.

Further, if the extension member is formed integrally with the head rail and if the extension member is formed into a plate shape having substantially the same length as that of the head rail, the number of parts can be prevented from increasing and the number of manufacturing steps of the head rail and the extension member can almost be prevented from increasing.

On the other hand, even in the cases that the upper end of the first fabric is attached to the front surface of the head rail, that the upper end of the second fabric is attached to the rear surface of the head rail, and that the second lift cord is pulled out into the rear side of the head rail so as to come over the upper end of the second fabric to be suspended into the rear side of the second fabric, the present roman shade does not require the insertion hole, having been required in the convention roman shade, for guiding the second lift cord to the rear side of the second fabric. Accordingly, the insertion hole is no longer necessary for the present roman shade, and therefore the number of manufacturing steps in forming the insertion hole, which has been necessitated for the second fabric in the conventional roman shade, can be omitted. In this case, if the head rail is configured to enclose the first lift cord or the front side cord roll-up drum, and the second lift cord or the rear side cord roll-up drum, a width of the head rail can be equalized to that of the head rail which encloses a single roll-up drum, resulting in preventing the amount of projection of the first fabric into the room from increasing. Also, if the head rail is configured such that the lower space sectioned by the partition encloses the first lift cord or the front side cord roll-up drum, and the upper space sectioned by the partition encloses the second lift cord or the rear side cord roll-up drum, a mutual cushioning can be prevented. Further, if the second lift cord pulled out into the rear side of the head rail from the upper space is provided with a guide member for guiding the second lift cord to the rear side of the second fabric, the guide member guides the second lift cord having been pulled out into the rear side of the head rail to the rear side of the second fabric, such that the second lift cord and the second fabric are prevented from causing an unnecessary friction resistance. Therefore, an operation load upon lifting up/down the second fabric can be reduced.

BRIEF DESCRIPTION OF THE DRAWINGS

FIG. 1 is a cross sectional view of a roman shade of FIG. 3 according to the first embodiment of the present invention taken along line A-A.

FIG. 2 is a cross sectional view corresponding to the roman shade of FIG. 1 illustrating a state immediately before a first fabric and a second fabric are attached to a head rail of the roman shade.

FIG. 3 is a cut-way front view of a main portion of the roman shade.

FIG. 4 is a side view of the roman shade.

FIG. 5 is a cross sectional view of the roman shade of FIG. 6 according to another embodiment of the present invention taken along line B-B.

FIG. 6 is a cut-away front view of a main portion of the roman shade.

FIG. 7 is a cross sectional view of the roman shade of FIG. 8 according to a second embodiment of the present invention taken along line A-A.

FIG. 8 is a cut-away front view of a main portion of the roman shade.

FIG. 9 is an enlarged view of a portion B of FIG. 8.

DETAILED DESCRIPTION OF THE INVENTION

Now, an embodiment for carrying out the present invention will be described with reference to the accompanying drawings.

As shown in FIGS. 1 and 4, a roman shade 10 includes: a head rail 16 mounted onto a wall surface 14 of a room through a fixing bracket 13; a first fabric 11 and a second fabric 12 of which upper ends are attached to the head rail 16, respectively, and which have substantially the same length as that of the head rail 16; and a first lift cord 21 and a second lift cord 22 suspended from the head rail 16 in a liftable manner and coupled to the first fabric 11 and the second fabric 12, respectively. The head rail 16 is formed into a reverse U-shape in cross section by means of an extrusion molding or a pultrusion molding for metal such as an aluminum alloy, and has a top plate portion 16*a*, a front wall 16*b* suspended from a front edge of the top plate portion 16*a*, and a rear wall 16*c* suspended from a rear edge of the top plate portion 16*a*.

As shown in FIGS. 1 and 2 in detail, a front surface of the head rail 16, i.e., a front surface of the front wall 16*b* of the head rail 16 is provided with the first fabric 11 through a first hook-and-loop fastener 31. The first hook-and-loop fastener 31 includes a first band plate 31*a* which is made of a relatively thick rigid plastic or the like having substantially the same length as that of the head rail 16; a plurality of first hook-like projections 31*b* arranged tightly side by side on a surface of the first band plate 31*a*; a first band-like fabric 31*c* having substantially the same length as that of width of the first fabric 11; and a plurality of first ring-like projections 31*d* which are arranged tightly side by side on a surface of the first band-like fabric 31*c* and which are engaged with the first hook-like projections 31*b* in a disengageable manner. An upper section and a central lower section of the front wall 16*b* of the head rail 16 are provided with a pair of first hooks 16*d*, 16*d* for supporting an upper edge and a lower edge of the first band plate 31*a* in a longitudinal direction of the head rail 16, respectively, and an upper edge of the rear surface of the first fabric 11 is stitched with the first band-like fabric 31*c*. Accordingly, the upper end of the first fabric 11 is attached to the front surface of the head rail 16 in an disengageable manner. Here, the pair of first hooks 16*d*, 16*d* are provided integrally with the head rail 16.

On the other hand, an extension member 17 is provided at a rear portion of the head rail 16. The extension member 17 extends downwardly along a lower edge of a rear wall 16*c* of the head rail 16. Also, the extension member 17 is provided integrally with the head rail 16, and is formed into a substantially reverse dogleg shaped plate having substantially the same length as that of the head rail 16. A lower section of the front surface of the extension member 17 is provided with the second fabric 12 attached thereto through the second hook-and-loop fasteners 32. The second hook-and-loop fastener 32 is formed substantially in the same manner as the first hook-and-loop fastener 31, and includes a second band plate 32*a* made of a relatively thick rigid plastic or the like, a plurality of second hook-like projections 32*b* which are arranged tightly side by side on a surface of the second band plate 32*a*, a second band-like fabric 32*c*, and a plurality of second ring-like projections 32*d* which are arranged tightly side by side on a surface of the second bank-like fabric 32*c* and engaged with the second hook-like projections 32*b* in a disengageable manner.

Also, a center section and a lower section of the extension member 17 are provided with a pair of second hooks 17*a*, 17*a*, respectively, in a longitudinal direction of the extension member 17 in order to hold an upper edge and a lower edge of the second band plate 32*a*, and an upper edge of the rear surface of the second fabric 12 is stitched with the second band-like fabric 32*c*. Further, the second hook-and-loop fastener 32 is provided such that it extends in the longitudinal direction of the extension member 17 and the width direction of the second fabric 12, respectively, on the front surface of the lower section of the extension member 17 and the upper edge of the rear surface of the second fabric 12 except for the unattached portion 18 having a predetermined width. The unattached portion 18 is a space having a predetermined width including a suspended portion of the second lift cord 22 suspended from a cord insertion member 19, i.e., a portion where the upper end of the second fabric 12 is not attached to the front surface of the extension member 17, viewing from a front of the second fabric 12. Accordingly, the upper end of the second fabric 12 is attached to the front surface of the lower section of the extension member 17 in a disengageable manner. The pair of second hooks 17*a*, 17*a* are provided integrally with the head rail 16. The predetermined width of the unattached portion 18 is set to a range between 1 cm and 10 cm, more preferably be set to a range between 2 cm and 5 cm, although it depends on a thickness of the second fabric 12 or a gauge of the second cord 22. A reason why the predetermined width of the unattached portion 18 is set to the range between 1 cm and 10 cm is that a smooth lifting of the second lift cord 22 can not be achieved with the width less than 1 cm, and that a deterioration of an appearance of the second fabric 12 occurs with a width beyond 10 cm since a portion of the upper edge of the second fabric 12 may be apart from the extension member 17.

On the other hand, a space 16*e* enclosed by the top plate portion 16*a*, the front wall 16*b*, and the rear wall 16*c* of the head rail 16 enclose a plurality of cord insertion members 19 (two cord insertion members are exemplified in FIG. 3) at any positions in the longitudinal direction of the head rail 16. The cord insertion members 19 are engaged in the space of the head rail 16 in a disengageable manner so as to divide the space 16*e* into a lower space 16*f* and an upper space 16*g* by the cord insertion members 19. As shown in FIGS. 1 and 2, the plurality of first lift cords 21 are inserted into the lower space 16*f*. One ends of the first lift cords 21 are suspended from the corresponding predetermined cord insertion members 19 and are inserted into a plurality of first cord rings 41 arranged on the rear surface of the first fabric 11 at predetermined spaces in a vertical direction to thereby be routed vertically downward, and then are coupled to first weight bars 51 attached to a lower end of the first fabric 11 or first cord rings 41 at the lowermost end (FIG. 4 illustrates a case where the one end of the first cord insertion member is coupled to the first cord ring 41). Also, the other ends of the first lift cords 21 are inserted into the cord insertion members 19 to be guided to the right across the lower space 16*f* and are inserted into a stopper 23 as stop means provided at a lower section of the right end of the head rail 16, and then are suspended from the stopper 23 to be coupled to a first operation knob 61.

On the other hand, a plurality of second lift cords 22 are inserted into the upper space 16*g*. One ends of the second lift cords 22 are suspended from the corresponding predetermined cord insertion members 19 and further inserted into the unattached portion 18 of a predetermined width formed between the second fabric 12 and the extension member 17, and then are inserted into a plurality of second cord rings 42 attached on the rear surface of the second fabric 12 at a predetermined space in a vertical direction to be routed vertically downward, and are further coupled to second weight bar 52 attached to the lower end of the second fabric 12 or second cord rings 42 at the lowermost end of the second fabric (FIG. 4 illustrates a case where the other end of the second lift cord is coupled to the second cord ring 42 at the lowermost end.). The other ends of the second lift cords 22 are inserted into the cord insertion members 19 to be guided to the right across the upper space 16*g* so as to be inserted into the stopper 23, and then are suspended from the stopper 23 to be coupled to second operation knob 62.

The stopper 23 is configured to prohibit or allow a lift-up of the first lift cord 21 or the second lift cord 22 at a side where the first operation knob 61 and the second operation knob 62 are provided. More specifically, when the first lift cord 21 at the side where the first operation knob 61 is provided is rolled up after once it is rolled down, the stopper 23 prohibits the roll-up of the first lift cord 21, whereas when the first lift cord 21 having been prohibited from rolling-up is rolled down once, the first lift cord 21 is allowed to be rolled up again. That is, when the first lift cord 21 at the side where the first operation knob 61 is provided is rolled up, the first lift cord 21 suspended from the cord insertion member 19 of the head rail 16 and coupled to the first fabric 11 rolls down, whereas when the first lift cord 21 at the side where the first operation knob 61 is provided is rolled down, the first lift cord 21 at the side where it is coupled to the first fabric 11 is rolled up to thereby tuck up the first fabric 11.

On the other hand, when the second lift cord 22 at the side where the second operation knob 62 is provided is rolled up after it is once rolled down, the stopper 23 prohibits a roll-up of the second lift cord 22, whereas, when the second lift cord 22 having been prohibited from its rolling up is once rolled down, the second lift cord 22 is allowed to be rolled up again. That is, when the second lift cord 22 at the side where the second operation knob 62 is provided is rolled up, the second lift cord 22 suspended from the cord insertion member 19 of the head rail 16 and coupled to the second fabric 12, is rolled down, whereas, when the second lift cord 22 at the side where the second operation knob 62 is provided is rolled down, the second lift cord 22 at the side coupled to the second fabric 12 is rolled up to thereby tuck up the second fabric 12. As described above, the first lift cord 21 and the second lift cord 22 can be moved up and down independently; however, the first lift cord 21 and the second lift cord 22 are configured to be moved up and down concurrently by operating a coupling member 24 which couples the first lift cord 21 and the second lift cord 22 at upper sides of the first operation knob 61 and the second operation knob 62.

On the other hand, the fixing bracket 13 has a first block body 71 including a front claw 71*a* formed thereon, and a second block body 72 including a rear claw 72*a* formed thereon. The second block body 72 is configured to moved in a back and forth direction with regard to the first block body 71, and the front claw 71*a* and the rear claw 72*a* are configured to hold the head rail 16 from the front side and the rear side thereof. Also, the first block body 71 is fixed to the wall surface 14 of the room by a wood screw 26 (FIG. 4). Further, a front end and a rear end of the top plate portion 16*a* of the head rail 16 are provided with a front side engagement portion 16*h* and a rear side engagement portion 16*i* to be engaged by the corresponding front claw 71*a* and rear claw 72*a*, respectively. The second block body 72 is pushed against a direction in which the front claw 71*a* approaches to the rear claw 72*a* owing to a not shown spring, and the head rail 16 is fixed to the wall surface 14 of the room almost horizontally by supporting the head rail 16 from the front side and the rear side thereof with the front claw 71*a* and the rear claw 72*a* (FIG. 4). In the meantime, the front side engagement portion 16*h* and the rear side engagement portion 16*i* are provided integrally with the head rail 16, and the front side engagement portion 16*h* also serves as a first hook 16*d* for holding the upper edge of the first band plate 31*a* of the first hook-and-loop fastener 31.

Use of the roman shade 10 having the above configuration will be described below.

The first fabric 11 or the second fabric 12 is lifted up/down by operating the first operation knob 61 or the second operation knob 62 provided at the right side of the head rail 16 in a manner corresponding to the first fabric 11 and the second fabric 12. For example, when lifting up the first fabric 11, the first operation knob 61 is pulled down to thereby pull down the first lift cord 21 at the side where the first operation knob 61 is provided as well as the first lift cord 21 at the side coupled to the first fabric 11 is lifted up, resulting in rising the first weight bar 51. At the time, the first fabric 11 is tucked up while it is forming pleats between the adjacent first cord rings 41. If a power for pulling down the first operation knob 61 is slacked off, the stopper 23 prohibits the rolling-up of the first lift cord 21 and keep the tucked up condition of the first fabric 11 as it is. On the other hand, when the first fabric 11 is lifted down, the first operation knob 61 is pulled down a little bit to allow the roll-up of the first lift cord 21 of the side where the first operation knob 61 is provided, and thereafter the first operation knob 21 is gradually lifted up. Accordingly, the first lift cord 21 of the side coupled to the first fabric 11 is lifted down by own weights of the first weight bar 51 and the first fabric 11. Also, the second fabric 12 can be lifted up/down by operating the second operation knob 62 in the same way as the first operation knob 61. In the present embodiment, the head rail is mounted onto the wall surface of the room through the fixing bracket; however, the head rail may be mounted onto a ceiling surface of the room through the fixing bracket.

In the roman shade 10 having the above configuration, the upper end of the first fabric 11 is attached to the front surface of the head rail 16 and the upper end of the second fabric 12 is attached to the front surface of the extension member 17, i.e., the upper end of the first fabric 11 is attached to the front surface of the head rail 16 facing to a wide space open to the inside of the room after the upper end of the second fabric 12 is attached to the front surface of the extension member 17 also facing to the wide space open to the inside of the room. As a result thereof, in comparison with the conventional roman shade in which the second fabric is attached to the rear surface of the head rail through a relatively small space between the rear surface of the head rail mounted onto the wall surface or the like of the room and the wall surface of the room, the roman shade 10 of the present invention has improvements in not only an attachment operability of the first fabric 11 but also an attachment operability of the second fabric 12. Also, the first lift cord 21 suspended from the head rail 16 is routed into the rear side (which may also be referred to as a wall-facing side) of the first fabric 11, and the second lift cord 22 suspended from the head rail 16 in order to lift the second fabric 12 is inserted into the unattached portion 18 which is not attached to the front surface of the extension member 17 to guide the second lift cord 22 to the rear side of the second fabric 12 from the front side thereof, such that the second lift cord 22 is almost completely separated from the first lift cord 21, i.e., the second lift cord 22 would not be entangled with the first lift cord 21. As a result thereof, the first fabric 11 can be prevented from an unintentional lift-up/lift-down when the second lift cord 22 is rolled up/down, such that only the second fabric 12 can be securely lifted. In other words, without causing a trouble with a function of the second lift cord 22 in lifting the second fabric 12, such a case is effectively avoidable that the first fabric 11 interferes with the second fabric 12 and the first fabric 11 is, thereby, tucked up along with the second fabric 12. In the conventional roman shades, there were problems that the appearance is degraded since the insertion hole formed near the upper end of the second fabric is exposed to the inside of the room when only the first fabric is tucked up near to the head rail while the second fabric is down, and that the number of manufacturing steps will increase because of a formation of the insertion hole in the second fabric. To the contrary, since the roman shade 10 of the present invention does not include the insertion hole formed near the upper end of the second fabric 12, the appearance of the second fabric 12 will not be degraded even if only the first fabric 11 is tucked up near to the head rail 16 while the second fabric 12 is down, and the number of manufacturing steps of the second fabric 12 will not increase. Also, in the conventional roman shades, when a strong sunlight or the like shines on the second fabric while both of the first fabric and the second fabric are down, there was such a problem that a strong light in the form of a spot light is irradiated onto the first fabric through the insertion hole formed in the second fabric to thereby filter light in the form of a spot light into the room. To the contrary, in the roman shade 10 of the present invention, since no insertion hole is formed in the second fabric 12, even if a strong light such as a sunlight shines onto the second fabric 12 while both of the first fabric 11 and the second fabric 12 are down, a strong light in the form of a spot light will not be irradiated onto the first fabric 11, and therefore, no filtering of the light in the form of the spot light would occur into the room.

Further, the first fabric 11 and the second fabric 12 cover the opening (not shown) such as a window of a house from the inside of the room, and thus may be made of the same fabric; however, if the second fabric 12 is made of an opaque fabric and the first fabric 11 is made of a block-out fabric, the two pieces of the fabric 11, 12 can provide a light shielding effect. However, a combination of the pieces of the fabric will not be limited to the above. Various combinations can be made, for example, one fabric 11 or 12 is made of a transparent fabric and the other fabric 12 or 11 is made of an opaque fabric, or two pieces of the fabric 11, 12 are made of the pieces of the fabric having different patterns. Therefore, even after the head rail 16 is mounted onto the wall surface or the like of the room, the first fabric 11 and the second fabric 12 can be changed to another ones, as needed, according to the user's taste, and therefore, the patterns, the designs, or the like of the fabric will be changed. Here, in the conventional roman shades, since a space between the rear surface of the head rail and the wall surface of the room is relatively small, there were such problems that there relatively is a cumbersome in an operation of exchanging the second fabric attached to the rear surface of the head rail, and that an operation of exchanging the second fabric requires time. To the contrary, in the roman shade 10 of the present invention, since the upper end of the second fabric 12 is attached to the front surface of the extension member 17 facing to a wide space open to the inside of the room, the operation for exchanging the upper end of the second fabric 12 with regard to the front surface of the extension member 17 becomes remarkably easy.

Meantime, in the above first embodiment, such an example is described that the first lift cord 21 is inserted into the lower space 16*f* sectioned by the cord insertion member 19 and the second lift cord 22 is inserted into the upper space 16*g*; however, it may also be possible that the second lift cord 22 is inserted into the lower space 16*f* sectioned by the cord insertion member 19 and the first lift cord 21 is inserted into the upper space 16*g*.

Also, in the above described first embodiment, it was exemplified that the first lift cord is guided within the head rail in a longitudinal direction of the head rail to be suspended from the end of the head rail; however, such a configuration may be possible that, as shown in FIGS. 5 and 6, a plurality of drums 91 capable of rolling up the first lift cord 21 are provided within the head rail 16 in a feedable manner and the first lift cord 21 is moved up and down by rotating these drums 91. More specifically, a plurality of drum containers 92 are fixed in the longitudinal direction of the head rail 16 within the head rail 16 at a predetermined distance, and the drum containers 92 hold the corresponding drums 91 in a rotatable manner. Each drum 91 is coupled to the other end of the first lift cord 21 in a roll-up manner and in a feedable manner. One end of the first lift cord 21 is suspended from the predetermined corresponding drum 91 and inserted into a plurality of first cord rings 41 attached to the rear surface of the first fabric 11 at a predetermined distance to be routed vertically downward, and then is coupled to the first weight bar 51 attached to the lower end of the first fabric 11 or the lowermost first cord ring 41. A single rotatable shaft 93 is inserted into each of the drums 91, and these drums 91 are configured to rotate with the rotatable shafts 93. The rotatable shaft 93 is provided within the head rail 16 such that it extends in the longitudinal direction of the head rail 16 to be coupled to a first operation unit 95 at a left end of the rotatable shaft 93. The first operation unit 95 is housed in a case 95*a*, and having a sprocket (not shown), an engagement portion (not shown) to be provided under the sprocket, and an operation chain 95*b* which is rolled around the sprocket and suspended from a lower end of the case 95*a*. In the roman shade 90 having the above configuration, upon operation of the operation chain 95*b*, the sprocket and the rotatable shaft 93 rotate, and thereby the drum 91 rotates to allow the first fabric 11 to rise.

On the other hand, each of the drum containers 92 is provided with pins 94 extending in a back and forth direction of the head rail 16 in a rotatable manner, and the plurality of second lift cords 22 are hooked around these pins 94. One ends of these second lift cords 22 are suspended from the predetermined corresponding pins 94, are inserted into the unattached portions 18 of a predetermined width formed between the second fabric 12 and the extension member 17, and thereafter are inserted into the plurality of second cord rings 42 attached to the rear surface of the second fabric 12 at a predetermined distance in the vertical direction to be routed vertically downward, and is finally coupled to the second weight bar 52 attached to the lower end of the second fabric 12 or the lowermost second cord ring 42. The other end of the second lift cord 22 is guided to the right within the head rail 16 to be inserted into the stopper 23, and suspended from the stopper 23 to be coupled to the second operation knob 62. The second fabric 12 is lifted up and down by operating the second operation knob 62 in a similar manner as described in the above embodiment. Such a configuration is available that the second lift cord is rolled up around the drum within the head rail in a feedable manner, and the drum is rotated to move the second lift cord in an up and down direction. Also, in FIGS. 5 and 6, the same numerical references will indicate the same parts as those in FIGS. 1 and 3.

In FIGS. 5 and 6, it has been described that the plurality of drums 91 provided within the head rail 16 can feed the first lift cords 21; however, it is also possible to configure the drums 91 to feed the second lift cords 22, and the drums 91 are rotated to move the second lift cords 22 in the up and down direction, thereby guiding the first lift cords 21 to extend in the longitudinal direction within the head rail.

Although it is not illustrated, it may be so configured that the head rail 16 includes therein the plurality of drums 91 for rolling up the first lift cords 21 in a feedable manner and the plurality of drums for rolling up the second lift cords 21 in a feedable manner, respectively, and thereby the drums are rotated to move the first lift cords 21 and the second lift cords 22 in the up and down direction.

Now, another embodiment of the present invention will be described with reference to FIGS. 7 through 9.

As illustrated in FIGS. 7 and 8, a roman shade 110 includes a head rail 113 mounted to a wall surface 112 (FIG. 7) of a room through a fixing bracket 111. The head rail 113 is formed by means of an extrusion molding or a pultrusion molding using an aluminum alloy or the like, and, as shown in FIG. 7 in detail, includes a top plate portion 113*a*, a front wall 113*b* suspended from a front edge of the top plate portion 113*a*, and a rear wall 113*c* suspended from a rear edge of the top plate portion 113*a*. A space enclosed by the top plate portion 113*a*, the front wall 113*b*, and the rear wall 113*c* is divided into two sections, i.e., an upper section and a lower section, and therefore an interior space of the head rail 113 comes to include an upper space 113*f* formed therein by a partition 113*e* above the partition 113*e* and a lower space 113*g* formed beneath the partition 113*e*. A rear side slit 113*n* continuous in a longitudinal direction is formed in the rear wall 113*c* at the rear side of the upper space 113*f*. Also, a bottom slit 113*k* continuous in a longitudinal direction of the head rail 113 is formed at a bottom of the lower space 113*g*. On the other hand, the fixing bracket 111 includes a front block body 111*c* on which a front claw 111*a* and an engagement projection 111*b* are formed, and a rear claw hid configured to be movable in a back and forth direction with regard to the front block body 111*c*. The front block body 111*c* is fixed to the wall surface 112 of the room by a wood screw 111*e*.

The front end of the top plate portion 113*a* of the head rail 113 is provided with a front side engagement portion 113*h* and an engagement groove 113*m* with which the front claw 111*a* and the engagement projection 111*b* are engaged, respectively, and the rear end of the top plate portion 113*a* is provided with a rear side engagement portion 113*i* with which the rear claw hid is engaged. In a state that the rear claw hid is pushed by a not shown spring against a direction in which the rear claw approaches to the front claw 111*a* and the front side engagement portion 113*h* and the engagement groove 113*m* are engaged with the front claw 111*a* and the engagement projection 111*b*, respectively, the rear side engagement portion 113*i* is engaged with the rear claw 111*d* to thereby allow the head rail 113 to be fixed onto the wall surface 112 of the room. The front side engagement portion 113*h*, the engagement groove 113*m*, and the rear side engagement portion 113*i* are provided integrally with the head rail 113, As shown in FIGS. 7 and 8, the roman shade 110 includes a first fabric 114 and a second fabric 115 of which upper ends are attached to the head rail 113 and which have the substantially same width as that of the head rail 113. The front surface of the head rail 113, i.e., an upper portion of the front surface of the front wall 113*b* of the head rail 113, is provided with the first fabric 114 attached thereto through a front side hook-and-loop fastener 116. As illustrated in FIG. 7 in detail, the front side hook-and-loop fastener 116 includes a front side band plate 116*a* made of a relatively thick rigid plastic or the like having substantially the same length as that of the head rail 113, and a front side band-like fabric 116*b* having substantially the same length as a width of the first fabric 114. Although it is not illustrated, a surface of the front side band plate 116*a* is provided with not shown front side hook-like projections tightly arranged thereon side by side, and a plurality of not shown front side ring-like projections which are engaged with the front side hook-like projections in a disengageable manner are tightly arranged side by side on the surface of the front side band-like fabric 116*b*. An upper section and a center section of the front wall 113*b* of the head rail 113 are provided with a pair of front side hooks 113*d*, 113*d* for supporting an upper edge and a lower edge of the front side band plate 116*a* so as to extend in a longitudinal direction of the head rail 113, respectively, and an upper edge of the rear surface of the first fabric 114 is stitched with the front side band-like fabric 116*b*. Accordingly, the upper end of the first fabric 114 is attached to the front surface of the head rail 113 in a disengageable manner. The pair of front side hooks 113*d*, 113*d* are provided integrally with the head rail 113.

On the other hand, the rear surface of the head rail 113, i.e., a lower portion of the rear surface of the rear wall 113*c* of the head rail 113, is provided with the second fabric 115 attached thereto through a rear side hook-and-loop fastener 117. The rear side hook-and-loop fastener 117 is configured almost in the same way as the front side hook-and-loop fastener 116, and includes a rear side band plate 117*a* made of a relatively thick rigid plastic or the like and a rear side band-like fabric 117*b*. Although it is not illustrated, a surface of the rear side band plate 117*a* is provided with a plurality of rear side hook-like projections tightly arranged thereon side by side, and the rear side ring-like projections are provided tightly arranged side by side on the surface of the rear side band-like fabric 117*b* so as to be engageable with the rear side hook-like projections in a disengageable manner. The center portion and the lower portion of the rear wall 113*c* of the head rail 113 are provided with a pair of rear side hooks 113*j*, 113*j* for supporting an upper edge and a lower edge of the rear side band plate 117*a* so as to extend in the longitudinal direction of the head rail 113, and an upper edge of the front surface of the second fabric 115 is stitched with the rear side band-like fabric 117*b*. Accordingly, the upper end of the second fabric 111 is attached to the lower portion of the rear surface of the head rail 113 in a disengageable manner. The pair of rear side hooks 113*j*, 113*j* are provided integrally with the head rail 113.

Further, the roman shade 110 includes a first lift cord 121 and a second lift cord 122 which are suspended from the head rail 113 so as to be able to be rolled up and rolled down from the head rail 113 and which are coupled to the first fabric 114 and the second fabric 115, respectively. On the other hand, the lower space 113*g* formed within the head rail 113 below the partition 113*e* is provided with a plurality of front side cord roll-up drums 123 in order to roll-up the first lift cords 121 in a feedable manner, and the upper space 113*f* formed within the head rail 113 above the partition 113*e* is provided with a plurality of rear side cord roll-up drums 124 in order to roll-up the second lift cords 122 in a feedable manner. Then, it is configured that the first lift cords 121 are moved in an up and down direction by rotating the front side cord roll-up drums 123, and that the second lift cords 122 are moved in an up and down direction by rotating the rear side cord roll-up drums 124.

Here, the front side cord roll-up drum 123 and the rear side cord roll-up drum 124 have the same configuration and are supported by drum containers 125, 126 having the same configuration each other, respectively. The front side cord roll-up drum 123 will be initially described. As illustrated in FIGS. 8 and 9 in detail, the plurality of drum containers 125 are fixed within the lower space 113*g* at a predetermined distance in the longitudinal direction of the head rail 113, and the drum containers 125 hold the front side cord roll-up drums 123 in a rotational manner. Each drum container 125 includes a pair of support portions 125*a*, 12Sb for supporting both ends of the front side cord roll-up drum 123, and a main body portion 125*c* for coupling the pair of support portions 125*a*, 125*b*. The first lift cord 121 of which top is rolled around the front side cord roll-up drum 123 is loosely inserted into one end of the main body portion 125*c*, and a guide member 125*d* for guiding the first lift cord 121 from the lower space 113*g* to the outside, i.e., a downward direction of the head rail 113, is formed integrally therewith. The guide member 125*d* formed at one end of the main body portion 125*c* has a rectangular shape in cross section and has a cylindrical body defined with a hole through which the first lift cord 121 is loosely inserted. And, the guide member 125*d* is provided with guide pins 125*e*, 125*e* which are orthogonal to each other so as to divide the rectangular hole into 114 sections.

The other end of the main body portion 125*c* is provided with a fixing handle 125*f* for fixing the main body portion 125*c* at a desired position of the lower space 113*g*. Although a detailed description of the fixing handle 125*f* will be omitted here, the fixing handle 125*f* is configured such that a 90 degree rotation of the fixing handle enables a movement of the drum container 125 in the longitudinal direction of the head rail 113 within the lower space 113*g*, and such that another 90 degree rotation of the fixing handle 125*f* in an opposite direction, i.e., a recovery of a position, enables a fixing of the main body portion 125*c* in the lower space 113*g*.

A bottom slit 113*k* formed in the bottom of the lower space 113*g* within the head rail 113 is configured such that the guide member 125*d* can be inserted in the longitudinal direction of the head rail 113, and the drum container 125 is inserted into the lower space 113*g* so as to allow the guide member 125*d* to come into the bottom slit 113*k* to recover the fixing handle 125*f* at the desired position, thereby fixing the plurality of drum containers 125 at a predetermined distance in the longitudinal direction of the head rail 113.

As shown in FIG. 7, a ring 123*a*, which slides in a shaft direction but rotates along with the front side cord roll-up drum 123, is fit onto the front side cord roll-up drum 123 held by the drum container 125 fixed at a desired position within the lower space 113*g* and the other end of the first lift cord 121 is coupled to the ring 123*a*. The first lift cord 121 is loosely inserted into the guide member 125*d* from the predetermined corresponding front side cord roll-up drum 123 to be guided to the outside of the head rail 113, i.e., below the head rail 113, from the lower space 113*g*, and suspended therefrom. On the other hand, the rear surface of the first fabric 114 is provided with a plurality of front side cord rings 127 attached thereto at a predetermined distance in a vertical direction. The first lift cord 121 suspended from the lower space 113*g* is inserted into the front side cord rings 127 to be routed vertically downward, and the lower end of the first lift cord 121 is coupled to the lowermost front side cord ring 138 of the first fabric 114.

A single lower stage rotatable shaft 129 is inserted into each of the front side cord roll-up drums 123, and each front side cord roll-up drum 123 is configured to rotate along with the lower stage rotatable shaft 129. As shown in FIG. 8, the lower stage rotatable shaft 129 is provided such that it extends in the longitudinal direction of the head rail 113 within the lower space 113*g* of the head rail 113, and one end thereof is coupled to a front side operation unit 131, while the other end thereof is coupled to the stopper 132. The front side operation unit 131 is contained within a case 131*a*, and includes a sprocket 131*b* and an operation chain 131*c* rolled around the sprocket 131*b* and suspended from the lower end of the case 131*a*. Then, a movement of the operation chain 131*c* in an up and down direction contributes to rotate the sprocket 131*b* together with the lower stage rotatable shaft 129, and the rotation of the lower stage rotatable shaft 129 contributes to rotate the front side cord roll-up drum 123 to thereby lift up/down the first lift cord 121.

The stopper 132 coupled to a left end of the lower stage rotatable shaft 129 is configured so as to prohibit or allow such a rotation of the front side cord roll-up drum 123 that it feeds the first lift cord 121. More specifically, if the operation chain 131*c* is operated to rotate the front side cord roll-up drum 123 together with the lower stage rotatable shaft 129 to thereby initially roll up the first cord 121 followed by roll down thereof, the stopper 132 prohibits such a rotation of the front side cord roll-up drum 123 that it feeds the first lift cord 121, and, if the front side cord roll-up drum 123 is slightly rotated in order to have the first cord 121 rolled up again from the above mentioned state, the stopper 132 allows such a rotation of the front side cord roll-up drum 123 that it feeds the first lift cord 121. Then, when the operation chain 131*c* is operated to roll up the first lift cord 121, the first fabric 114 coupled to the first lift cord 121 can be tucked up.

On the other hand, the upper space 113*f* is provided with the plurality of drum containers 126 fixed therein at a predetermined distance in the longitudinal direction of the head rail 113. Each of the drum containers 126 has the same configuration as the one fixed in the lower space 113*g*, and the rear side cord roll-up drum 124 is held by the drum container 126 in a rotatable manner. Since the drum container 126 has the same configuration as the one holding the front side cord roll-up drum 123, a repetitive description thereof will be omitted here.

As shown in FIG. 7, the rear side slit 113*n* formed in the rear side of the upper space 113*f* is configured such that the guide member 126*d* in the drum container 126 can be inserted in the longitudinal direction of the head rail 113, the drum container 126 is inserted into the upper space 113*f* so as to have the guide member 126*d* insert into the rear side slit 113*n*, and the fixing handle 126*f* is recovered at the predetermined position, resulting in that the plurality of drum containers 126 are fixed at a predetermined distance in the longitudinal direction of the head rail 113.

The ring 124*a*, which rotates with the rear side cord roll-up drum 124 but slides in the shaft direction thereof, is fit onto the rear side cord roll-up drum 124 held by the drum container 126 fixed at a predetermined position within the upper space 113*f*, and the other end of the second lift cord 122 is coupled to the ring 124*a*. The second lift cord 122 is loosely inserted into the guide member 126*d* from the corresponding predetermined rear side cord roll-up drum 124 to pass through the rear side slit 113*n* from the upper space 113*f*, resulting in being guided to the outside of the upper space 113*f*, i.e., to the back of the head rail 113. Here, the guide member 126*d* formed on the drum container 126 guides the second lift cord 122 having been pulled into the rear side of the head rail 113 from the upper space 113*f* to the rear side of the second fabric 115, and the second lift cord 122 is pulled out into the rear side of the head rail 113 such that it comes over the upper end of the second fabric 115 from the upper space 113 to be suspended into the rear side of the second fabric 115.

On the other hand, a plurality of rear side cord rings 133 are attached to the rear surface of the second fabric 115 at a predetermined distance in a vertical direction. The second lift cord 122 pulled out and suspended into the rear side of the head rail 113 such that it comes over the upper end of the second fabric 115 from the upper surface 113*f* is inserted into the rear side cord rings 133 to be routed in the vertical direction, and then, the lower end of the second lift cord 122 is coupled to the lowermost rear side cord ring 139 of the second fabric 115.

As shown in FIG. 8, a single upper stage rotatable shaft 136 is inserted in each of the rear side cord roll-up drums 124, and each rear side cord roll-up drum 124 is configured such that it rotates together with the upper stage rotatable shaft 136. As shown in FIG. 9, the upper stage rotatable shaft 136 is provided such that it extends in the longitudinal direction of the head rail 113 in the upper space 113*f* of the head rail 113, one end thereof is coupled to a rear side operation unit 137, and the other end thereof is coupled to the stopper 132 (FIG. 9). The rear side operation unit 137 has the same configuration as the front operation unit 131, i.e., it is housed in a case 137*a*, and includes a sprocket 137*b* and an operation chain 137*c* which is rolled around the sprocket 137*b* and suspended from the lower end of the case 137*a*. A movement of the operation chain 137*c* in an up and down direction enables a rotation of the sprocket 137*b* together with the upper stage rotatable shaft 136, and a rotation of the upper stage rotatable shaft 136 enables a rotation of the rear side cord roll-up drum 124 to allow the second lift cord 122 to be lifted up and down.

The stopper 132 coupled to a left end of the upper stage rotatable shaft 136 is configured such that it prohibits or allows a rotation of the rear side cord roll-up drum 124 so as to feed the second lift cord 122. More specifically, it is configured that, when the operation chain 137*c* is operated to rotate the rear side cord roll-up drum 124 together with the upper rotatable shaft 136 and thereby roll up the second lift cord 122, followed by rolling down thereof, the stopper 132 prohibits such a rotation of the rear side cord roll-up drum 124 that it feeds the second lift cord 122, and, when the rear side cord roll-up drum 124 is slightly rotated so as to roll up the second lift cord 122 from the above described state and thereafter the second lift cord 122 is rolled down again, the stopper 132 allows the rear side cord roll-up drum 124 to rotate so as to feed the second lift cord 122. Then, a roll-up of the second lift cord 122 by operating the operation chain 137*c* enables to tuck up the second fabric 115 coupled to the second lift cord 122.

The case 137*a* of the rear side operation unit 137 is configured such that it houses a periphery of the edge of one end of the head rail 113 and is provided with a not shown cap at the other end of the head rail 113. The cap is also configured to house a periphery of the edge of the other end of the head rail 113. As described above, the head rail 113 is configured such that both ends thereof are enclosed around its periphery so as to prevent the bottom slit 113*k* formed in the bottom of the head rail 113 in the longitudinal direction of the head rail and the rear side slit 113*n* formed at the rear side of the upper space 113*f* in the longitudinal direction of the head rail 113 from being widened, respectively.

Now, use of the roman shade having the above configuration will be described below.

The first fabric 114 or the second fabric 115 is lifted up and down by operating the front side operation unit 131 or the rear side operation unit 137 arranged at a right side of the head rail 113 so as to correspond to the first fabric 114 or the second fabric 115, respectively (FIG. 9). For example, when the first fabric 114 is lifted up, the operation chain 131*c* in the front side operation unit 131 is operated to roll up the first lift cord 121, thereby rolling up the lowermost front side cord ring 138. Then, the first fabric 114 is tucked up while it is forming pleats between the adjacent front side cord rings 127. Also, when the second fabric 115 is lifted up, the operation chain 137*c* in the rear side operation unit 137 is operated to roll up the second lift cord 122, thereby rolling up the lowermost rear side cord ring 139. Then, the second fabric 115 is tucked up while it is forming pleats between the adjacent rear side cord rings 133. When the first fabric 114 and the second fabric 115 having been tucked up are rolled down, the front side cord roll-up drum 123 and the rear side cord roll-up drum 124 are slightly rotated so as to roll up the first cord 121 and the second cord 122 again to release the stopper 132, thereby feeding the first lift cord 121 and the second lift cord 122 from the corresponding drums 123, 124, respectively. Accordingly, the first fabric 114 and the second fabric 115 can be lifted down together with the first lift cord 121 and the second lift cord 122 owing to the own weights of the first fabric 114 and the second fabric 115. In the present embodiment, it is exemplified that the head rail is mounted onto the wall surface of the room through the fixing bracket; however, the head rail may be mounted onto the ceiling surface of the room through the fixing bracket.

In the roman shade 110 having the above described configuration, the front side cord roll-up drum 123 for rolling up the first lift cord 121 and the rear side cord roll-up drum 124 for rolling up the second lift cord 122 are provided separately; however, since the head rail 113 encloses the lower space 113*g* for housing the front side cord roll-up drum 123 and the upper space 113*f* for housing the rear side cord roll-up drum 124 above the lower space 113*g*, a width of the head rail 113 can be made into the same length as that of the head rail which houses a single roll-up drum. As a result thereof, an amount of first fabric 114 projecting to the room can be prevented from increasing.

The first lift cord 121 for lifting the first fabric 114 is suspended from the head rail 113 to have the first lift cord be routed into the rear side of the first fabric 114, and the second lift cord 122 for lifting the second fabric 115 is pulled out into the rear side of the head rail 113 from the upper space 113 f to be guided and suspended into the rear side of the second fabric 115, such that the second lift cord 122 is almost completely isolated from the second lift cord 122. Therefore, the second lift cord 122 would not be entangled with the second lift cord 122. As a result thereof, unintentional lift-up/down of the first fabric 114 can be prevented when the second lift cord 122 is lifted up/down, such that only the second fabric 115 can be securely lifted. In other words, without causing any trouble in a function of the second lift cord 122 which lifts up/down the second fabric 115, such a case can be effectively avoided that the first fabric 114 interferes with the second fabric 115 upon tucking up the second fabric 115 to have the first fabric 114 tucked up together with the second fabric 115.

Further, in the conventional roman shades, there was such a problem that, when only the first fabric is tucked up near to the head rail while the second fabric is down, the insertion hole formed near the upper end of the second fabric is exposed to the inside of the room, which degrades the appearance thereof. However, in the roman shade 110 of the present invention, since the second lift cord 122 having been pulled out into the rear side of the head rail 113 from the upper space 113*f* is guided into the rear side of the second fabric 115, and the second lift cord 122 is pulled out into the rear side of the head rail 113 so as to come over the upper end of the second fabric 115 from the upper space 113*f* to suspend the second lift cord at the rear side of the second fabric 115, such that the appearance of the second fabric 115 would not be degraded even if only the first fabric 114 is tucked up near to the head rail 113 while the second fabric 115 is down.

In the present embodiment, since there is provided the guide member 126*d* which guides the second lift cord 122 having been pulled out into the rear side of the head rail 113 from the upper space 113*f* to the rear side of the second fabric 115, the guide member 126*d* guides the second lift cord 122 having been pulled out into the rear side of the head rail 113 to the rear side of the second fabric 115 to prevent a friction resistance between the second lift cord 122 and the second fabric 115 from increasing unnecessarily. Therefore, an operation load upon lifting up/down the second fabric 115 can be reduced.

In the above described embodiment, it is exemplified that the bottom slit 113*k* and the rear side slit 113*n* are prevented from being widened by enclosing the both ends of the head rail 113 from the periphery thereof; however, it may also be possible to independently prepare members for preventing the bottom slit 113*k* and the rear side slit 113*n* from being widened to arrange those members at a predetermined distance in a longitudinal direction of the head rail. In such a case, for example, hooks 125*h*, 126*h* for preventing the bottom slit 113*k* and the rear side slit 113*n* from being widened may be added to the guide members 125*d*, 126*d* which are inserted into the bottom slit 113*k* and the rear side slit 113*n*. Also, such a function may be added to the bracket 111 for mounting the head rail 113 onto the wall surface 112 that the bottom slit 113*k* and the rear side slit 113*n* are prevented from being widened.

In the above described embodiment, it is exemplified that the front side cord roll-up drum 123 for rolling up the first lift cord 121 and the rear side cord roll-up drum 124 for rolling up the second lift cord 122 are provided; however, a top of either one of the first lift cord 121 or the second lift cord 122 may be guided in the longitudinal direction of the head rail 113 within the head rail 113 to be suspended downwardly from the lower end of the head rail 113. Even in this case, a width of the head rail 113 can be equalized to that of the head rail for housing a single roll-up drum, and thus an amount of the first fabric 114 projecting into the room can be prevented from increasing. The first lift cord 121 or the front side cord roll-up drum 123 is housed within the lower space 113*g* sectioned by the partition 113*e*, and the second lift cord 122 or the rear side cord roll-up drum 124 is housed within the upper space 113*f* sectioned by the partition 113*e*, such that a mutual cushioning therebetween can be prevented.

The present invention is applicable to a roman shade in which a first fabric and a second fabric, of which upper ends are attached to a head rail respectively, can be lifted up and down by means of a first lift cord and a second lift cord which are coupled to the first fabric and the second fabric respectively.

The invention claimed is:

1. A roman shade comprising:

a head rail;

a first fabric having upper ends attached to the head rail;

a second fabric having upper ends attached to the head rail;

a first lift cord suspended from the head rail and configured to be rolled into the head rail, the first lift cord coupled to the first fabric;

a front side cord roll-up drum for rolling up the first lift cord;

a second lift cord suspended from the head rail and configured to be rolled into the head rail, the second lift cord coupled to the second fabric;

a rear side cord roll-up drum for rolling up the second lift cord; and a partition for dividing the head rail into two sections of an upper section and a lower section, the partition forming within the head rail:

a lower space for housing the front side cord roll-up drum; and an upper space for housing the rear side cord roll-up drum above the lower space;

wherein an upper end of the first fabric is attached to a front surface of the head rail;

wherein the first lift cord suspended from the head rail is routed into a rear side of the first fabric;

wherein an upper end of the second fabric is attached to a rear surface of the head rail;

wherein the second lift cord is pulled out into a rear side of the head rail so as to come over an upper end of the second fabric to be suspended into the rear side of the second fabric; and wherein the head rail encloses the front side cord roll-up drum and the rear side cord roll-up drum above the front side cord roll-up drum.

2. The roman shade according to claim 1, wherein a top of the first lift cord suspended from the head rail is guided in a longitudinal direction within the head rail to be suspended downwardly from the end of the head rail, and a top of the second lift cord suspended from the head rail is guided in the longitudinal direction of the head rail within the head rail above or beneath the first lift cord to be suspended downwardly from the end of the head rail.

3. The roman shade according to claim 2, wherein the top of the second lift cord is guided in the longitudinal direction within the head rail above the first lift cord;

wherein a partition is provided in order to divide the head rail into two sections of an upper section and a lower section; and wherein a lower space for housing the first lift cord extending in the longitudinal direction, and an upper space above the lower space for housing the second lift cord extending in the longitudinal direction are formed within the head rail by using the partition.

4. The roman shade according to claim 1, wherein a drum for rolling up at least one of the first lift cord or the second lift cord is provided within the head rail, and the other one of the first lift cord or the second lift cord is guided in the longitudinal direction within the head rail to be suspended downwardly from the end of the head rail.

5. The roman shade according to claim 4, further comprising a partition for dividing the head rail into two sections of an upper section and a lower section, the partition forming:

a lower space for housing a drum which rolls up, at least one of the first lift cord or the first lift cord extending in the longitudinal direction within the head rail, and an upper space for housing a drum which rolls up the second lift cord or the second lift cord extending in the longitudinal direction above the lower space.

6. The roman shade according to claim 3 further comprising a guide member for guiding the second lift cord, having been pulled out into the rear side of the head rail from the upper space, to the rear side of the second fabric.

7. The roman shade according to claim 5 further comprising a guide member for guiding the second lift cord, having been pulled out into the rear side of the head rail from the upper space, to the rear side of the second fabric.

8. The roman shade according to claim 1 further comprising a guide member for guiding the second lift cord, having been pulled out into the rear side of the head rail from the upper space, to the rear side of the second fabric.

9. The roman shade according to claim 1, wherein the rear side is a wall-facing side.

* * * * *